United States Patent [19]

Lawter

[11] 4,439,051

[45] Mar. 27, 1984

[54] SINGLE PRINTING STATION, MULTIPLE RECORD MEMBER FEEDING MECHANISM

[75] Inventor: Raymond L. Lawter, Zanesville, Ohio

[73] Assignee: NCR Corporation, Dayton, Ohio

[21] Appl. No.: 423,368

[22] Filed: Sep. 24, 1982

[51] Int. Cl.[3] ..... B41J 11/50

[52] U.S. Cl. ..... 400/605; 400/158.1; 400/551; 400/636

[58] Field of Search ..... 400/600, 600.1, 605, 400/636, 637, 637.1, 649, 158.1, 551

[56] References Cited

U.S. PATENT DOCUMENTS

| | | | |
|---|---|---|---|
| 3,753,483 | 8/1973 | Lundquist et al. | 400/649 |
| 4,056,183 | 11/1977 | Beery | 400/649 X |
| 4,145,146 | 3/1979 | Ohkawara et al. | 400/605 X |
| 4,227,819 | 10/1980 | Manriquez | 400/649 X |

FOREIGN PATENT DOCUMENTS

| | | | |
|---|---|---|---|
| 2716396 | 10/1978 | Fed. Rep. of Germany | 400/605 |
| 2717758 | 10/1978 | Fed. Rep. of Germany | 400/605 |
| 2912656 | 10/1980 | Fed. Rep. of Germany | 400/605 |
| 733804 | 10/1932 | France | 400/636 |
| 55-121085 | 9/1980 | Japan | 400/600.1 |
| 426605 | 4/1935 | United Kingdom | 400/637 |

*Primary Examiner*—Clyde I. Coughenour
*Assistant Examiner*—John A. Weresh
*Attorney, Agent, or Firm*—J. T. Cavender; Wilbert Hawk, Jr.; Richard W. Lavin

[57] ABSTRACT

A single drive mechanism providing selective feeding of at least two printing media and independent bi-directional movement of the media in the operation of a single print station. The drive mechanism including a platen member is movable to allow the two printing media to be positioned in the print station for a printing operation. The platen member is rotated in opposite directions to feed the two printing media to a printing position.

10 Claims, 2 Drawing Figures

SINGLE PRINTING STATION, MULTIPLE RECORD MEMBER FEEDING MECHANISM

BACKGROUND OF THE INVENTION

The present invention is directed to a printing mechanism and more particularly to a paper feed mechanism for positioning a plurality of different size record members adjacent a single printing mechanism.

In modern day merchandising operations utilizing a data terminal device, a sales slip is positioned in a printing station to allow a printing mechanism to print on the sales slip data relating to the purchase of a merchandise item. Besides the printing of data on a sales slip, the same data is printed on other record members such as a receipt member and a journal member. Printing mechanisms associated with modern data terminal devices have included a single print head or like mechanism which is mounted on a movable carriage for movement across several printing stations where data is printed on record members positioned in each of said stations. Other arrangements have included a single printing mechanism at each printing station to print on the record member located therein. In order to produce a low-cost, compact data terminal device, single printing mechanisms have been proposed which are capable of printing on more than one type of record member at the same printing station. An example of this type of printing mechanism may be found in U.S. Pat. No. 4,074,797, issued in the name of Lewis et al. and assigned to the assignee of the present application. And while such mechanism accomplished its intended purpose, it was found that the cost was high due to the complexity of its construction. It is therefore a principal object of this invention to provide a single station printing mechanism which is capable of printing on different types of record documents. It is a further object of this invention to provide a single station printing mechanism which includes a record member drive mechanism which also functions as a forms compensator. It is a further object of this invention to provide a single station printing mechanism which is compact in construction and low in cost.

SUMMARY OF THE INVENTION

These and other objects of the invention are fulfilled by providing a single station printing mechanism which includes a rotatably mounted platen member cooperating with a movable pressure roller and stationary pressure rollers to transport a first record document from a supply roll to a printing position. A printing mechanism located at the printing position prints data on the record document. Driving means associated with the platen member rotates the platen member in a direction to feed the printed record document to a position enabling the operator to remove the record document from the printing station. A deflector member operated by the rotation of the platen member positions the printed record document for removal by the operator.

When a multi-form record document is to be printed, the movable pressure roller is withdrawn from engagement with the platen member and the driving means reverses the rotation of the platen member allowing the platen member to withdraw the first record document from the printing position. Actuating means associated with the platen member removes the platen member from the printing position allowing a multi-form record document to be located in the printing position by the operator. The platen member is then returned to the printing position moving the multi-form record document against the stationary pressure rollers, which movement positions the platen member with respect to the printing mechanism which compensates for the thickness of the record document being printed. At the completion of the printing operation, the platen member is again removed from the printing position allowing the multiform record document to be removed from the printing position.

BRIEF DESCRIPTION OF THE DRAWINGS

The foregoing and various other objects, advantages and meritorious features of the present invention will be apparent from the following detailed description and appended claims when read in conjunction with the drawings, wherein like numerals identify corresponding elements.

DESCRIPTION OF THE PREFERRED EMBODIMENT

Figure 1:
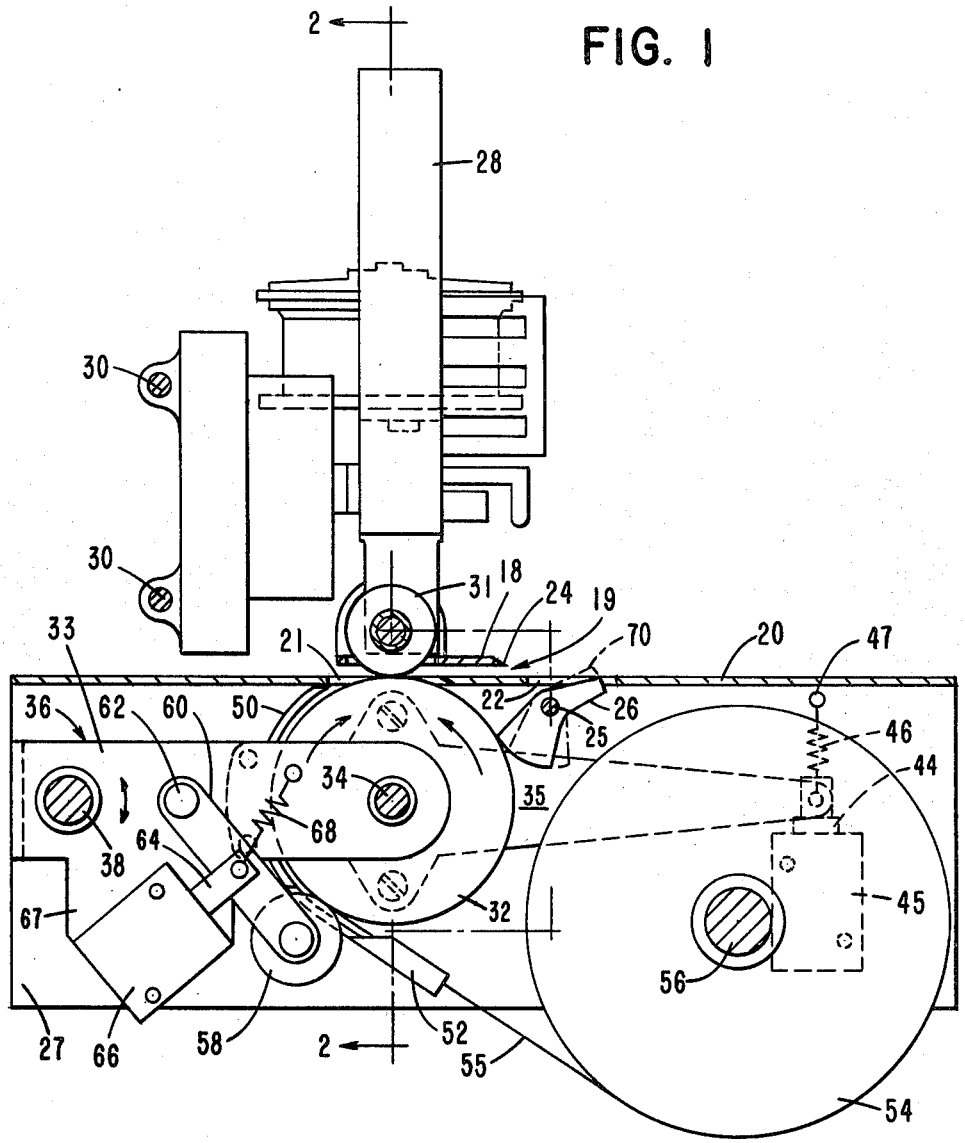
FIG. 1 is a fragmentary side elevational view of the printing station of the present invention.

Referring now to FIG. 1, there is shown a fragmentary side view of the printing station of the present invention which includes a support table 20 extending from the front to the rear of the terminal device (not shown) associated with the printing station. Included in the support table are a pair of slots generally indicated by the numerals 21 and 22. Located adjacent and spaced from the table 20 is a knife blade portion 18 of a side frame member 37 (FIG. 2) of the terminal device. As best seen in FIG. 1, the blade portion 18 extends towards the front edge of the table 20 forming a receipt/slip chute 19 with the table 20. As will be explained more fully hereinafter, a forward edge 24 of the blade portion 18 is serrated to enable a record member, such as a receipt member located within the chute 19, to be separated from a supply roll as will be described more fully hereinafter. Secured to a shaft 25 journaled between a pair of depending side frame members 27 and 29 (FIGS. 1 and 2), which frame members are part of the framework of the terminal device, is a deflector member 26 positioned below the slot 22 in the support table 20 and whose operation will be disclosed more fully hereinafter. Positioned adjacent the other slot 21 in such table 20 is a vertically-orientated printing mechanism 28 which may be of a dot matrix type slidably mounted for back-and-forth movement on a pair of guide rod members 30 extending in a horizontal direction (FIG. 2) across the support table 20.

Figure 2:
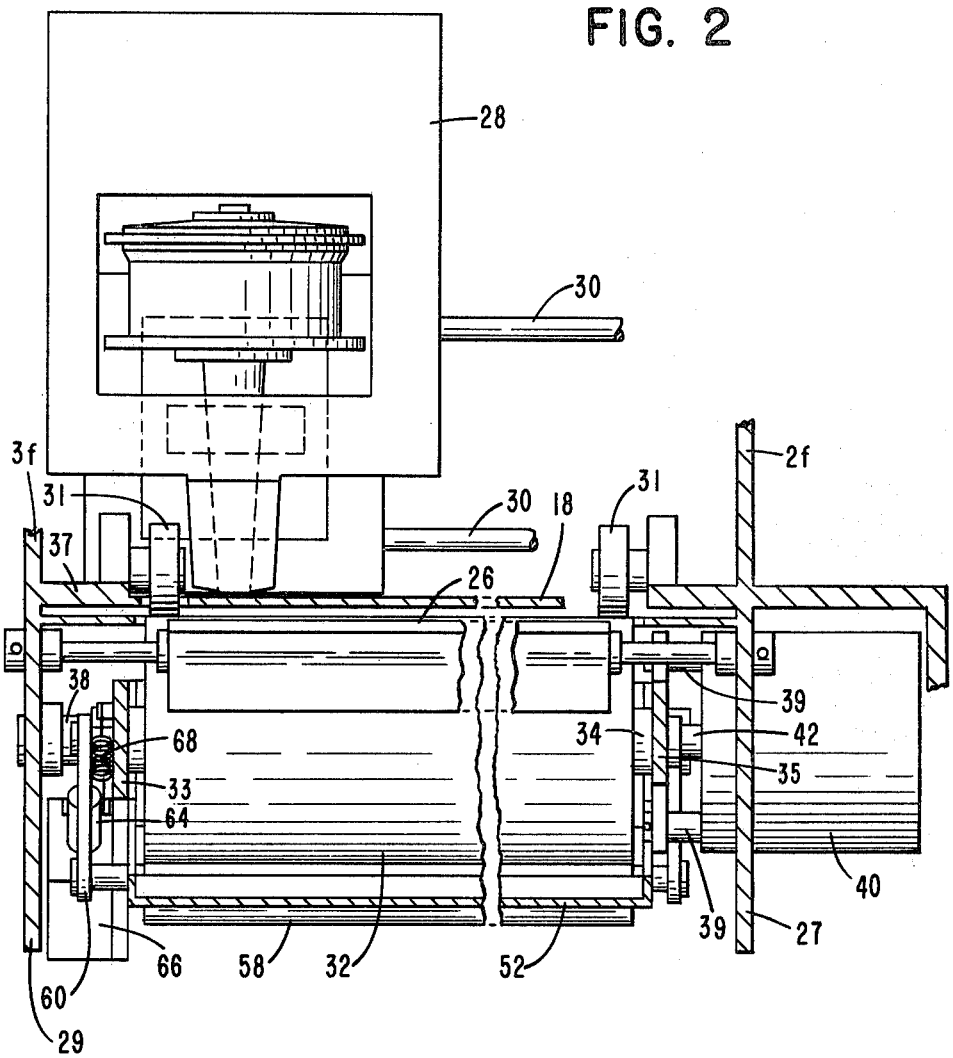
FIG. 2 is a cross-sectional view of the printing station taken on lines 2—2 of FIG. 1 showing details of the platen member driving means.

Mounted above and adjacent the ends of the slot 21 of the support table 20 is a pair of stationary pressure rollers 31 which are normally engaged by a platen roll member 32 secured to a drive shaft 34 journaled between arm members 33 and 35 of a yoke assembly indicated generally by the numeral 36 (FIG. 1). As shown in FIG. 1, the arm member 33 of the yoke assembly 36 is shorter than the arm member 35. The outer or left side pressure roller 31 as viewed in FIG. 2 is mounted within the side frame member 29 while the inner pressure roller 31 is mounted within the side frame member 27. As best seen in FIG. 1, the yoke assembly 36 is rotatably mounted on a shaft member 38 journaled between the side frame members 27 and 29 of the terminal device. As best shown in FIG. 2, secured to the yoke assembly 36, by means of studs 39, is a stepping motor member 40 whose drive shaft 42 is connected to the drive shaft 34 of the platen member 32 (FIG. 1) and which construction enables the stepping motor 40 to directly drive the platen 32 when energized. Additionally, the stepping motor 40 is constructed to be operated to rotate the drive shaft 42 in opposite directions.

Secured to the end of the longer arm member 35 of the yoke assembly 36 is the armature member 44 (FIG. 1) of a solenoid 45 mounted within the framework of the terminal device. Urging the yoke assembly 36 in a counterclockwise direction as viewed in FIG. 1 is a spring member 46 connected between the arm member 35 and a stud member 47 of the side frame 27. As seen from this construction, energizing of the solenoid 45 will result in rotation of the yoke assembly 36 in a clockwise direction around the shaft member 38 against the action of the spring 46. As will be described more fully hereinafter, this clockwise rotation of the yoke assembly enables the platen member 32 to be withdrawn from engagement with the pressure rollers 31 allowing a record member to be either removed from or inserted to a printing position adjacent the printing mechanism 28.

As best seen in FIG. 1, secured to and located within the yoke assembly 36 is the curved top portion 50 of a document guide member 52 which extends toward the front of the terminal device, which is to the right as viewed in FIG. 1. Positioned adjacent the lower surface of the support table 20 is a supply roll 54 of record material (such as a receipt record member 55) which is rotatably mounted on a shaft member 56 secured within the side frame members 27 and 29 of the terminal device. Associated with the guide member 52 is an idler roller 58 rotatably mounted on one end of a lever support member 60 which, in turn, is rotatably mounted on a shaft member 62 extending between the arm members 33 and 35 of the yoke assembly 36. Secured at a location intermediate the ends of the lever support member 60 is the armature 64 of a solenoid member 66 mounted on a depending portion 67 of the arm member 33 of the yoke assembly 36. Normally urging the lever support member 60 in a counter-clockwise direction, as viewed in FIG. 1, is a spring member 68 connected between the armature 64 and the arm member 33. The action of the spring member 68 normally urges the idler roller 58 into engagement with the platen member 32 enabling the platen member to move the receipt record member 55 held against the platen member by the idler roller 58.

In the operation of the present invention, the leading edge of a receipt record member 55 extending from the supply roll 54 will be inserted through the guide member 52 (i.e. between the top portion 50 of the guide member and the platen member 32), between the pressure rollers 31 and the platen member 32 and then through the receipt/slip chute 19 to a position adjacent the top surface of the support table 20. At this time normal positioning of the deflector member 26 (FIG. 1) has same rotated to the position shown in dotted lines 70, where the upper edge thereof is positioned a slight distance above the top surface of the table 20 so as to allow such deflector member 26 to deflect and guide the receipt record member 55 in a generally upward direction where it can be grasped by the machine operator. During a merchandising operation, the cost of each item sold is entered into the keyboard of the terminal device by the operator, enabling the printing mechanism 28 (FIG. 2) to be moved laterally along the guide rod members 30 to a position adjacent the receipt record member 55 whereat the data concerning the item purchased is to be printed. As the cost of each item is so entered, the stepping motor 40 is energized to rotate the platen member 32 in a clockwise direction as viewed in FIG. 1 for moving the receipt record member 55 a predetermined distance to position the next line of printing on the receipt record member adjacent the printing mechanism 28. After the total amount has been printed on the receipt record member 55, the end of such member is cut away by the operator pulling the receipt against the serrated edge 24 of the knife blade portion 18 of the frame member 37.

If the next document to be printed is an insertable slip record member, the stepping motor 40 is energized to rotate the platen member 32 in a counterclockwise direction enabling such platen member to withdraw the receipt record member 55 from a position adjacent the top surface of the table 20. This counterclockwise movement of the platen 32 will rotate the deflector member 26 in a clockwise direction, in turn moving the upper edge of the deflector member from a blocking position above the top surface of the support table 20. After the leading edge of the receipt record member 55 has been withdrawn to a position adjacent the top portion 50 of the guide member 52, the solenoid 66 (FIG. 1) is energized for rotating the lever support member 60 and the idler roller 58 in a clockwise direction around the shaft 62, thereby withdrawing the roller 58 from engagement with the receipt record member 55 and the platen member 32. Thereafter, the solenoid 45 is energized for rotating the yoke assembly 36 in a clockwise direction, which removes the platen member 32 from engagement with the pressure rollers 31. After the operator has positioned the slip member on the table 20 adjacent the printing mechanism 28, the solenoid 45 is deenergized for allowing the spring member 46 to rotate the yoke assembly 36 in a counter-clockwise direction and thus move the platen member 32 into engagement with the slip member and the pressure rollers 31. Since the platen member 32 is urged into engagement with the slip member by the action of the spring member 46, such platen member 32 will act as a forms compensator and be positioned with respect to the pressure rollers 31 a distance equal to the thickness of the slip member. This construction allows the wire matrix printer 28 to provide a proper print operation irrespective of the thickness of the slip member being printed.

After a printing operation has occurred, the stepping motor 40 is again operated to rotate the platen member 32 in a counter-clockwise direction for moving the slip member to locate the next printing line thereon adjacent the printing mechanism 28 for the next printing operation. After the printing of the data on the slip member has been completed, the solenoid 45 is again energized for rotating the yoke assembly 36 and the platen member 32 in a clockwise direction, thereby removing the platen member 32 from engagement with the slip member and thus allow the slip member to be removed from its position on the support table 20 by the operator. The solenoid member 45 is then deenergized for allowing the spring member 46 to rotate the yoke assembly 36 in a counter-clockwise direction, which movement returns the platen member 32 into engagement with the pressure rollers 31.

If the next printing operation is to be on the receipt record member 55, the solenoid member 66 is deenergized, allowing the spring member 68 to rotate the idler roller 58 into engagement with the receipt record member 55 and the platen member 32, in turn allowing the platen member 32, when rotated by the operation of the motor 40, to feed the receipt record member 55 toward the receipt/slip chute 19. During this feed operation, the clockwise rotation of the platen member 32 will automatically rotate the deflector member 26 in a counter-clockwise direction as viewed in FIG. 1 to locate the upper edge of the deflector member in the dotted position 70 as shown in FIG. 1, thus enabling such deflector member to deflect the leading edge of the receipt record member in an upward direction. Subsequent printing of data on the record member 55 will move the record member farther along the top of the support table 20, enabling the operator to tear the printed receipt record member from the end of the strip upon completion of the printing operation.

It will be seen from the structure just described that a plurality of different types of record members can be printed at the same printing station utilizing a simple and low-cost paper advance and drive mechanism.

While the principles of the invention have now been made clear in an illustrated embodiment, it will be obvious to those skilled in the art that many modifications of structure, arrangements, elements and components can be made which are particulary adapted for specific environments without departing from those principles. The appended claims are therefore intended to cover and embrace any such modifications within the limits only of the true spirit and scope of the invention.

I claim:

1. A mechanism for moving a plurality of first and second record members past a single printing station comprising:

a supporting surface;

a printing mechanism positioned adjacent said supporting surface for printing data on a record member positioned at a printing station on said supporting surface;

a first support member rotatably mounted adjacent said supporting surface for movement between a first printing positions and second nonprinting actuated position;

a platen member rotatably mounted between said first support member and a second support member and disposed adjacent said printing mechanism;

drive means engaging said platen member and mounted on said first support member, said drive means operable for rotating the platen member in a first and second feeding direction;

said second support member rotatably mounted adjacent said platen member;

a first driven roller member rotatably mounted on said second support member;

means engaging said second support member constructed for normally rotating said second support member in a direction to move the first driven roller member into engagement with said platen member, enabling said platen member to move a first record member positioned between the platen member and the driven roller member to said printing station adjacent said printing mechanism when rotated in said first feeding direction by said drive means and for removing the first record member from said printing station when rotated in said second feeding direction;

and first actuating means engaging said first support member and operable to rotate said first support member to said actuated position whereby said platen member is removed from said printing position enabling a second record member to be positioned on said supporting surface adjacent said printing mechanism.

2. The mechanism of claim 1 which further includes deflector means rotatably mounted adjacent said supporting surface in the path of movement of the first record member, said deflector means engaging said platen member and adapted to be moved by said platen member to a first position for locating said first record member in a position on said supporting surface enabling the record member to be removed from said printing station upon rotation of said platen member in said first feeding direction.

3. The mechanism of claim 2 which further includes a second actuating means mounted on said first support member and engaging said second support member, said second actuating means operable to rotate said second support member in a direction to remove the first roller member from engagement with said platen member thereby disabling said platen member from feeding the first record member to the printing station.

4. The mechanism of claim 3 in which said first support member comprises an elongated yoke member rotatably mounted adjacent said printing means and said first actuating means comprises an electromagnetic drive member engaging said yoke member and operable for rotating said yoke member in a direction to move the platen member away from said printing means.

5. The mechanism of claim 4 in which said yoke member includes first and second support arm portions for supporting said platen member and said drive means whereby upon operation of said electromagnetic drive member, said platen member and said drive means are rotated away from said printing means.

6. A mechanism for feeding a plurality of first and second record members past a single printing station comprising:

a supporting surface for supporting a record member in a printing position;

a printing mechanism positioned adjacent said supporting surface for printing data on a record member positioned at a printing station on said supporting surface;

a first support member rotatably mounted adjacent said supporting surface for movement between a first printing position and second nonprinting actuated position;

a platen member rotatably mounted between said first support member and a second support member and disposed adjacent said printing mechanism;

drive means mounted on said first support member and engaging said platen member, said drive means operable for rotating the platen member in a first and second feeding direction;

a supply of first record members;

guide means positioned adjacent said platen member for guiding said first record member from said supply to a position adjacent said platen member;

said second support member rotatably mounted on said first support member and positioned adjacent the platen member;

a first driven roller member rotatably mounted on said second support member adjacent said platen member and said guide member;

first means engaging said second support member for normally urging said second support member in a direction to move the first driven roller member into engagement with the first record member and the platen member enabling said platen member, when rotated in said first feeding direction, to move the first record member through said guide means to said printing station adjacent the printing mechanism and for removing the first record member from the printing station when rotated in said second feeding direction;

and first actuating means engaging said first support member and operable to rotate said first support member to said actuated position whereby said platen member is removed from said printing position enabling a second record member to be positioned on said supporting surface adjacent said printing mechanism.

7. The mechanism of claim 6 in which said supporting surface includes a slotted portion located adjacent said printing mechanism, said mechanism further includes a deflector member rotatably mounted adjacent said slotted portion and having one end engaging the edge of the platen member whereby upon rotation of the platen member in said first feeding direction, the deflector member is rotated to a position in the path of movement of the first record member for deflecting said record member to a position on the supporting surface enabling it to be removed from the printing position.

8. The mechanism of claim 7 in which said supply of first record members comprises a continuous strip of receipt record members, said mechanism further including a knife member positioned adjacent the slotted portion of said supporting surface and said deflector member enabling the printed receipt record member to be severed from the strip at the completion of the printing of data thereon.

9. The mechanism of claim 8 in which said first support member comprises a yoke member rotatably mounted adjacent said supporting surface and having an arm portion extending in a direction along said supporting surface, said first actuating means comprises a first electromagnetic drive member engaging said arm portion and operable to rotate said yoke member to said actuated position away from said supporting surface for moving the platen member from said printing position, said mechanism further includes first resilient means engaging said arm portion for subjecting the arm portion to a biasing force which normally rotates said yoke member in a direction to said first printing position.

10. The mechanism of claim 9 which further includes a second electromagnetic drive member mounted on said yoke member and engaging said second support member and operable for rotating said second support member in a direction removing said first driven roller member from engagement with said platen member, thereby disabling said platen member from moving said first record member through said guide means.

* * * * *